United States Patent [19]

Williams

[11] 4,246,555

[45] Jan. 20, 1981

[54] ODD ORDER ELLIPTIC FUNCTION NARROW BAND-PASS MICROWAVE FILTER

[75] Inventor: Albert E. Williams, Bethesda, Md.

[73] Assignee: Communications Satellite Corporation, Washington, D.C.

[21] Appl. No.: 926,056

[22] Filed: Jul. 19, 1978

[51] Int. Cl.[3] ..... H01P 1/208; H01P 1/209; H01P 7/06

[52] U.S. Cl. ..... 333/209; 333/212; 333/230

[58] Field of Search ..... 333/73 C, 73 W, 208, 333/209, 212, 230

[56] References Cited

U.S. PATENT DOCUMENTS

| | | | |
|---|---|---|---|
| 3,153,208 | 10/1964 | Riblet | 333/73 W |
| 3,737,816 | 6/1973 | Honicke | 333/73 W |
| 3,969,692 | 7/1976 | Williams et al. | 333/73 W |

FOREIGN PATENT DOCUMENTS

| | | | |
|---|---|---|---|
| 709509 | 5/1954 | United Kingdom | 333/73 W |

*Primary Examiner*—Marvin L. Nussbaum
*Attorney, Agent, or Firm*—Sughrue, Rothwell, Mion, Zinn and MacPeak

[57] ABSTRACT

Multiple coupled high Q cavities are used to generate odd order elliptic function band-pass filters using a minimum number of cavities connected by simple and resonant coupling elements. A specific embodiment of a 3-pole, 20 MHz band-pass wave guide cavity filter centered at 3890 MHz is disclosed. Couplings between cavities may be either on the end walls or the side walls. The simple coupling elements may be simple coupling holes, and the resonant coupling elements may be a non-shorting screw in a window between cavities.

5 Claims, 7 Drawing Figures

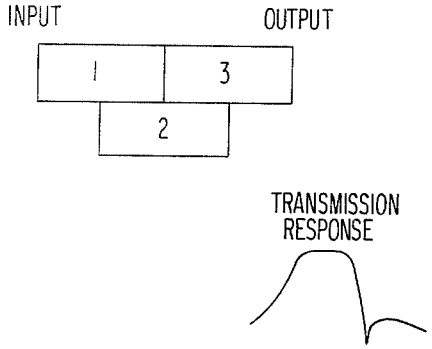
FIG 1a
(PRIOR ART)
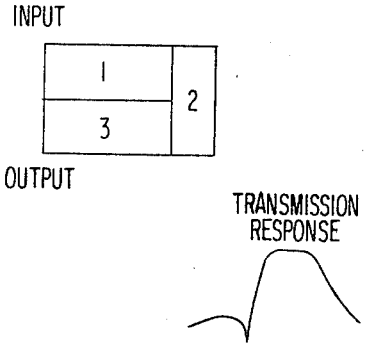
FIG 1b
(PRIOR ART)
FIG 2b
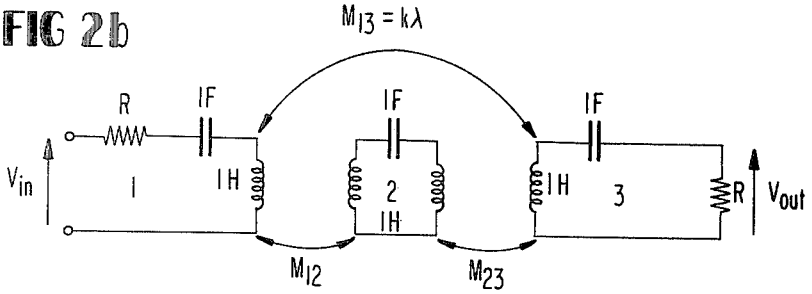
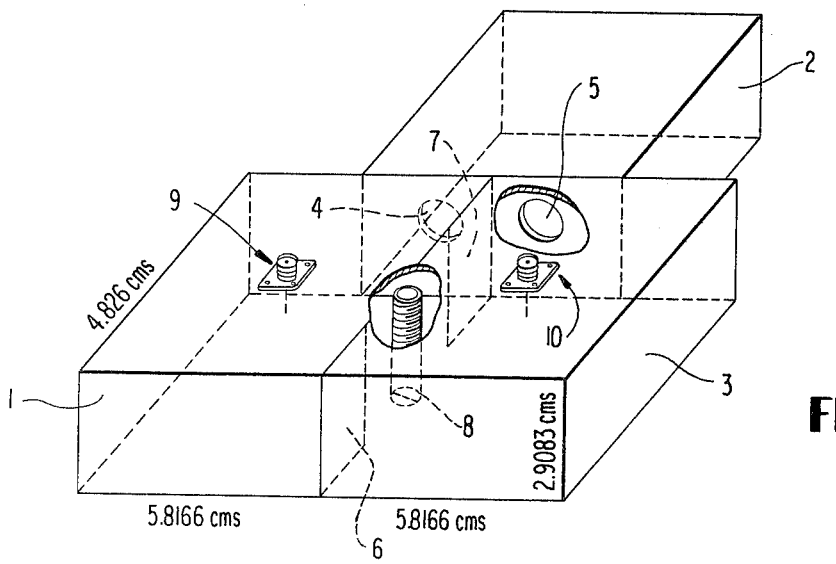
FIG 2a

ODD ORDER ELLIPTIC FUNCTION NARROW BAND-PASS MICROWAVE FILTER

BACKGROUND OF THE INVENTION

The present invention generally relates to wave guide filters and, more particularly, to odd elliptic function band-pass filters using multiple coupled high Q cavities.

The synthesis of multiple coupled high Q wave guide cavity filters has been outlined in the technical literature as represented by the following publications:

J. D. Rhodes, "The Generalized Direct-Coupled Cavity Linear Phase Filter," *IEEE Transactions MTT*, Volume MTT-18, No. 6, June 1970, pages 308–313;

A. E. Atia et al., "Narrow-Bandpass Waveguide Filters," *IEEE Transactions MTT*, Volume MTT-20, No. 4, April 1972, pages 258–264; and A. E. Atia et al., "Narrow-Band Multiple-Coupled Cavity Synthesis," *IEEE Transactions CAS*, Volume CAS-21, No. 5, September 1974, pages 649–655.

The type of structures described in the foregoing publications can generate transfer functions t(s) of the form $$t(s)=N(s)/D(s) \tag{1}$$

where $s=j(\omega-1/\omega)$, D(s) is a Hurwitz polynomial whose order equals that of the number of cavities, and N(s) is an even polynomial whose order 0 is $$0[N(s)]\leqq 0[D(s)]-2$$

That is, an even order elliptic function band-pass filter response can be generated, but an odd order response cannot. For example, for a fifth-order transfer function, the maximum order of [N(s)]=2, whereas a true fifth-order elliptic function response must realize an even fourth-order [N(s)].

A third-order coupled wave guide cavity band-pass filter has been described by R. M. Kurzrok, "General Three-Resonator Filters in Waveguide," *IEEE Transactions MTT*, Volume MTT-14, 1966, pages 46 and 47. This type of filter may take either of the configurations shown in FIGS. 1*a* or 1*b*. While not shown in the drawing, the FIG. 1*a* configuration has all magnetic (positive) couplings with series couplings between successively numbered cavities 1 and 2 and between cavities 2 and 3 as well as a coupling between non-successively numbered cavities 1 and 3. The FIG. 1*b* configuration has the same order of couplings between successive and non-successive cavities, except one is negative. The voltage-loop current relationship is given by $$\begin{pmatrix} V_{in} \\ 0 \\ 0 \end{pmatrix} = \begin{pmatrix} R+j\lambda & jM_{12} & jM_{13} \\ jM_{12} & j\lambda & jM_{23} \\ jM_{13} & jM_{23} & R+j\lambda \end{pmatrix} \begin{pmatrix} i_1 \\ i_2 \\ i_3 \end{pmatrix} \tag{2}$$

where the numerator N(λ) [$\lambda=\omega-(1/\omega)$] of the voltage transfer function is expressed as $$N(\lambda)\propto(\lambda M_{13}-M_{12}M_{23}) \tag{3}$$

The geometry of FIG. 1*a* (all positive couplings) then yields one real zero above the passband, while the geometry of FIG. 1*b* (one negative coupling) generates the zero below the passband. Both these responses are asymmetrical. While useful in certain applications, the conversion of these responses to the symmetrical odd order elliptic function filter response would be a positive achievement.

SUMMARY OF THE INVENTION

It is therefore the principle object of this invention to provide wave guide filters having symmetrical odd order elliptic function responses. The solution lies within the meaning of equation (3). Two symmetrical passband zeros will be generated if $M_{13}$ is positive when λ is positive, and $M_{13}$ is negative when λ is negative. This can be achieved by making $M_{13}$ a resonant iris whose resonance occurs at the same frequency as the high Q cavities and whose series reactance (X) can be written as $$X=k(\omega-1/\omega)=k\lambda \tag{4}$$

where k is the ratio of the series resonant slope parameters of the resonant iris and resonant cavity. The third-order filter can be extended to the nth order, with the following general result. The series couplings 1–2, 2–3, 3–4, . . . , (n−1)–n must be present and be simple constant couplings ($M_{ij}$). In addition, non-successively numbered cavities 1–3, 2–4, . . . , (n−3)–(n−1), (n−2)–n must be coupled by resonant irises. The simple couplings may be simple coupling holes in the common wall between adjacent cavities, and the resonant coupling elements may be a non-shorting screw in a window between cavities.

BRIEF DESCRIPTION OF THE DRAWINGS

In the drawings:

FIGS. 1*a* and 1*b* show geometries and transmission responses of prior art third-order coupled wave guide cavity band-pass filters;

FIGS. 2*a* and 2*b*, respectively, show a third-order wave gude elliptic function filter and its equivalent circuit;

DETAILED DESCRIPTION OF THE INVENTION

Figure 3A:
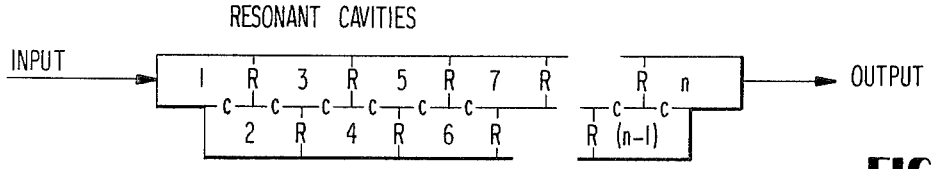
FIGS. 3*a* and 3*b*, respectively, show an nth-order (n being an odd integer) wave guide elliptic function filter and its equivalent circuit.

FIG. 2*a* shows a third-order wave guide elliptic function filter comprising cavities 1, 2 and 3 arranged with an end wall of cavity 2 common to one-half each of end walls of cavities 1 and 3, which, in turn, have a common side wall. Coupling between adjacent cavities 1 and 2 and between adjacent cavities 2 and 3 is by means of simple coupling holes 4 and 5, respectively. Each of these coupling holes are centrally located with respect to the common end wall portions of the respective adjacent cavities. Partial wall sections 6 and 7 of the common side wall of cavities 1 and 3 define a window between these cavities. Centrally located within this window is a resonant coupling screw 8. This screw projects from the bottom wall of the filter as viewed in the drawing toward the top wall but does not touch the top wall. The resonant coupling screw electrically appears as a series inductance and capacitance, the inductance being determined by the screw body and the capacitance being determined by the gap between the end of the screw and the top wall.

The partial wall sections 6 and 7 form a "window" dividing cavities 1 and 3. The size of this window opening together with the resonant screw diameter determines the value of k in equation (4). As is described later, this parameter is important in setting the response shape of the filter transfer function. The input and output of the filter are provided by means of coaxial probes 9 and 10, respectively, centrally located in the top broad walls of cavities 1 and 3. The edge dimensions shown in FIG. 2*a* for the cavities are those of a 20 MHz band-pass wave guide cavity filter centered at 3890 MHz which was actually built and testeo.

FIG. 2*b* shows the equivalent circuit. For convenience, couplings $M_{12}$ and $M_{23}$ are made equal and are realized by the simple circular hole magnetic couplings 4 and 5 (M). The resonant coupling ($M_{13}=k\lambda$) is realized by the screw 8 which is approximately $\lambda/4$ long. The voltage-loop current equation describing this circuit can be expressed as $$\begin{pmatrix} V_{in} \\ 0 \\ 0 \end{pmatrix} = \begin{pmatrix} R + j(1+k)\lambda & jM & jk\lambda \\ jM & j\lambda & jM \\ jk\lambda & jM & R + j(1+k)\lambda \end{pmatrix} \begin{pmatrix} i_1 \\ i_2 \\ i_3 \end{pmatrix} \tag{5a}$$

or $$V = Z_m I \tag{5b}$$

The power transfer function $|t(\lambda)|^2=4|V_{out}/V_{in}|^2$ is then given by $$|t(\lambda)|^2=4R^2|(Z_m)_{13}^{-1}|^2 \tag{6}$$

The parameters R, M and k can now be determined by comparing equation (6) to the third-order elliptic function filter transfer relation $$|t(\lambda)|^2 = \frac{1}{1 + \epsilon^2\lambda^2[(\lambda^2 - z^2)^2/(\lambda^2 - p^2)^2]} \tag{7}$$

where $\epsilon$ is a constant which determines the passband ripple, z is the zero of the characteristic function, and p is the pole of the characteristic function. The parameters are related by the following equations:

$$p = \frac{M}{\sqrt{k}} \tag{8}$$

$$z^2 = \frac{-(R^2 - 2M^2)}{(1 + 2k)} \tag{9}$$

$$\epsilon^2 = \frac{(1 + 2k)^2}{4R^2k^2} \tag{10}$$

These relationships were used to construct the third-order 20 MHz band-pass filter centered at 3890 MHz.

Figure 3B:
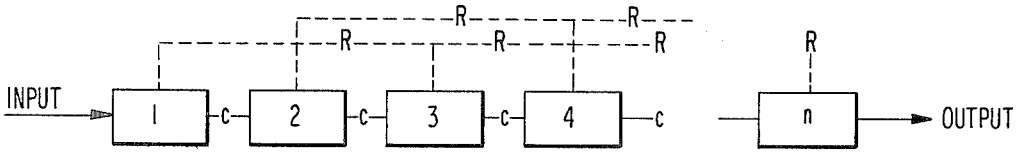

The principles of the third-order wave guide elliptic function filter can be generalized as shown in FIGS. 3*a* and 3*b*. FIG. 3*a* schematically shows the geometry of the cavities of an nth-order (n being an odd integer) wave guide elliptic function filter. The simple couplings between adjacent cavities 1−2, 2−3, 3−4, . . . (n−1)−n are represented by "c", whereas the resonant couplings between cavities 1−3, 3−5, . . . (n−2)−n are represented by "R". The same convention is adopted in the schematic representation of the equivalent circuit shown in FIG. 3*b*. When contrasted with FIG. 2*a*, it will be observed that the simple couplings and resonant couplings of the FIG. 3*a* structure are located in the side walls and end walls, respectively, instead of vice-versa. In other words, these couplings may be located in either the side walls or end walls, the choice being a matter of design depending on constraints of the overall physical dimensions allowed for the filter.

Figure 4:
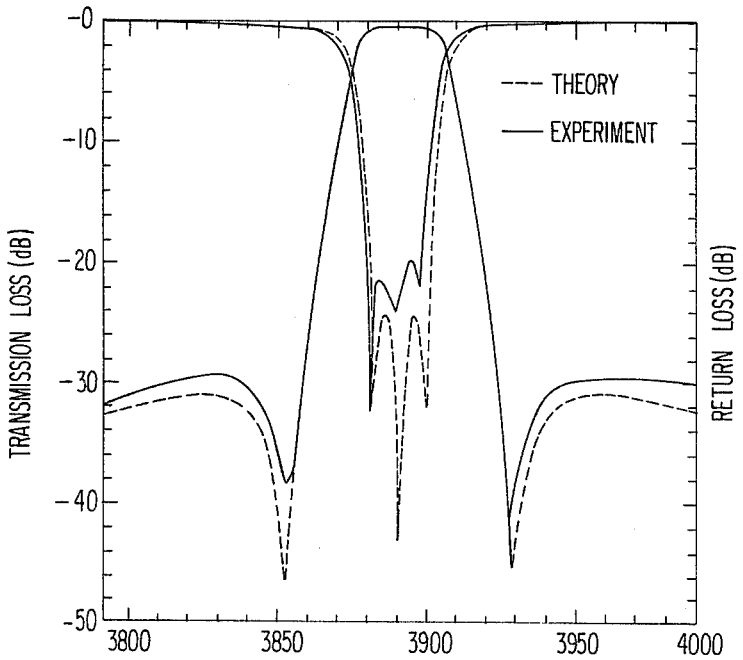
FIG. 4 is a graph showing experimental and theoretical responses of the third-order wave guide elliptic function wave guide filter shown in FIG. 2*a*.

FIG. 4 is a graph of the experimental and theoretical responses of the filter shown in FIG. 2*a*, and a comparison of these responses evidences excellent correlation.

What is claimed is:

1. An odd order elliptic function narrow band pass wave guide filter of the type having n cavities (n being an odd integer greater than 1) designated by reference numbers 1 to n respectively, wherein an input signal is received in cavity number 1 and coupled, in order, through cavities numeral 2 through n via simple coupling means for providing substantially constant coupling between successively numbered cavities, the improvement comprising:

resonant coupling means for providing a variable coupling between non-successively numbered cavities.

2. The filter according to claim 1 wherein successively numbered cavities share common cavity walls and said simple coupling means are simple coupling holes centrally located in the common cavity walls.

3. The filter according to claim 1, wherein said non-successively numbered cavities are adjacent one another and said resonant coupling means is a non-shorting screw centrally located within a window between adjacent non-successively numbered cavities, the width of said window and the diameter of said screw determining the series reactance of said resonant coupling means and hence the filter response.

4. The filter according to claim 1, wherein there are resonant coupling means between non-successively numbered cavities i and i+2 for $1 \leqq i \leqq (n-2)$.

5. The filter according to claim 1, wherein the variable coupling provided by said resonant coupling means varies between positive and negative values over the operating frequency of the filter.

* * * * *